US010512961B2

(12) United States Patent
Fabianek

(10) Patent No.: US 10,512,961 B2
(45) Date of Patent: Dec. 24, 2019

(54) PLATE ROLL BENDING MACHINE WITH DISTRIBUTED HYDRAULIC SYSTEM

(71) Applicant: Mega Manufacturing, Inc., Rockford, IL (US)

(72) Inventor: Michael Fabianek, Küssnacht (CH)

(73) Assignee: Mega Manufacturing, Inc., Rockford, IL (US)

( * ) Notice: Subject to any disclaimer, the term of this patent is extended or adjusted under 35 U.S.C. 154(b) by 547 days.

(21) Appl. No.: 15/349,702

(22) Filed: Nov. 11, 2016

(65) Prior Publication Data

US 2018/0133768 A1 May 17, 2018

(51) Int. Cl.
*B21D 5/14* (2006.01)
*B21D 5/00* (2006.01)

(52) U.S. Cl.
CPC *B21D 5/00* (2013.01); *B21D 5/14* (2013.01)

(58) Field of Classification Search
CPC ..... B21D 5/14; B21D 5/146; B21D 2269/00; B21D 2269/02; B21D 2269/04; B21D 2269/08; B21D 2269/10; B21D 11/023; B21D 7/02; B21D 7/022; B21D 7/024; B21D 7/028; B21B 2269/00; B21B 2269/02; B21B 2269/04; B21B 2269/08; B21B 2269/10
See application file for complete search history.

(56) References Cited

U.S. PATENT DOCUMENTS

| | | | | | |
|---|---|---|---|---|---|
| 5,187,959 | A * | 2/1993 | Davi | B21D 5/14 | 72/10.6 |
| 5,890,386 | A * | 4/1999 | Davi | B21D 5/14 | 72/13.4 |
| 5,970,770 | A * | 10/1999 | Caporusso | B21D 7/08 | 72/175 |
| 6,044,675 | A * | 4/2000 | Davi | B21D 5/14 | 72/173 |
| 9,468,961 | B2 * | 10/2016 | Davi | B21D 5/14 | |
| 2006/0053857 | A1 * | 3/2006 | Durney | B21D 5/00 | 72/319 |

* cited by examiner

*Primary Examiner* — Pradeep C Battula
(74) *Attorney, Agent, or Firm* — Leydig, Voit & Mayer, Ltd.

(57) ABSTRACT

A hydraulic roll bending machine includes a frame, a plate roller rotatably connected to the frame, a hydraulic power unit associated with the frame, and a network of conduits fluidly connected to a main feed of hydraulic fluid and a main return of hydraulic fluid of the hydraulic power unit. At least one hydraulic actuator having a housing is associated with the plate roller. The housing forms one or more fluid passages therein that are fluidly connected with activation chambers of the at least one hydraulic actuator. A valve system is connected onto the housing and is in selective fluid communication fluid passages and also with the network of conduits. The valve system is arranged to selectively fluidly interconnect the one or more passages with the network of conduits to operate the at least one hydraulic actuator.

20 Claims, 4 Drawing Sheets

PLATE ROLL BENDING MACHINE WITH DISTRIBUTED HYDRAULIC SYSTEM

FIELD OF THE DISCLOSURE

The present disclosure generally relates to plate roll bending machines and, more particularly, to plate roll bending machines having hydraulic cylinders.

BACKGROUND OF THE DISCLOSURE

The present disclosure relates roll bending machines having three or four rolls, which are well known in the metal fabricating industry for rolling metal plate into cylinders, obrounds and cone shapes. This type of machine uses hydraulic cylinders to change the relative position between the various rolls of the machine, and also hydraulic motors to rotate the rolls, such that plates can be formed in any desired shape.

The hydraulic systems of such machines commonly utilize a centrally located hydraulic manifold on which proportional valves, counterbalance valves, solenoid valves, flow control valves, oil pressure sensors and the like are mounted to operate hydraulic cylinders or motors that power and position gripping and bending rolls. In certain machines, the hydraulic manifolds are manufactured to National Fluid Power Association (NFPA) standard dimensions or International Standard Organization (ISO) standard dimensions and can be purchased from catalogs of various manufacturers. Similarly, the cylinders are manufactured to NFPA or ISO standard dimensions and can be purchased from catalogs form various manufacturers.

In a typical roll bending machine, pressurized hydraulic fluid is provided from a hydraulic pump into a manifold, which contains valves and other flow control devices that are fluidly connected, via tubes and hoses, to the various actuators of the machine. As is often the case, when an actuator is to be activated, a valve will open to port hydraulic fluid under pressure to the actuator; in other words, the pressurized fluid is conveyed to the actuator via piping that interconnects the manifold with the actuator. Depending on the location of the actuator on the machine, the piping may have to traverse a relatively short or relatively long distance before reaching the actuator.

In the past, machine designers have tried to place the manifold at a central location on the machine such that actuators that are required to be active simultaneously, for example, pairs of cylinders operating to adjust the position of a bending roll, are activated simultaneously and without delays. Nevertheless, it is not always practical to place the manifold in a location where all actuators on the machine are at equal distances. As a result, oil to one of the actuators often has to travel a longer or shorter distance than oil provided to the other actuator in a pair, based on the location of the actuators on the machine, which can cause imbalances during operation. Further, the oil is provided to the various actuators using different types of fluid conduits, for example, hard metal tubes or flexible rubber hoses, which introduces further imbalances to the system. Lastly, the temperature and resulting changes in compressibility of the hydraulic fluid, when the activating fluid has to travel relatively large distances before it acts on an actuator, introduces elasticity and vibration in the system.

BRIEF SUMMARY OF THE DISCLOSURE

In one aspect, the present disclosure describes a hydraulic roll bending machine. The hydraulic roll bending machine includes a frame, a plate roller rotatably connected to the frame, and a hydraulic power unit associated with the frame. A network of conduits is fluidly connected to a main feed of hydraulic fluid and a main return of hydraulic fluid of the hydraulic power unit. At least one hydraulic actuator, which has a housing, is associated with the plate roller. The housing forms one or more fluid passages therein that are fluidly connected with activation chambers of the at least one hydraulic actuator. A valve system is connected onto the housing in selective fluid communication with the one or more fluid passages. The valve system is in fluid communication with the network of conduits and arranged to selectively fluidly interconnect the one or more passages with the network of conduits to operate the at least one hydraulic actuator.

DETAILED DESCRIPTION

In one aspect, the disclosure relates to a hydraulic roll bending machine, which includes a frame and a plurality of hydraulic cylinders that are operated by a distributed hydraulic system (DHS). The DHS includes various components that distribute high pressure oil from a hydraulic pump to each actuator, at all times. Each actuator advantageously includes valves and other flow control devices that are integrated therewith and operate to selectively fluidly connect various portions of the actuator with the high pressure oil such that actions are performed in the machine. The fluid connections between the valves and the active portions of each actuator are over a short distance and use rigid conduits such that fluid compressibility, time delays in activation, elastic effects, and activation imbalances are reduced or eliminated. A controller operates to provide command signals to the valves in a coordinated fashion that improves operation of the machine.

Figure 1:
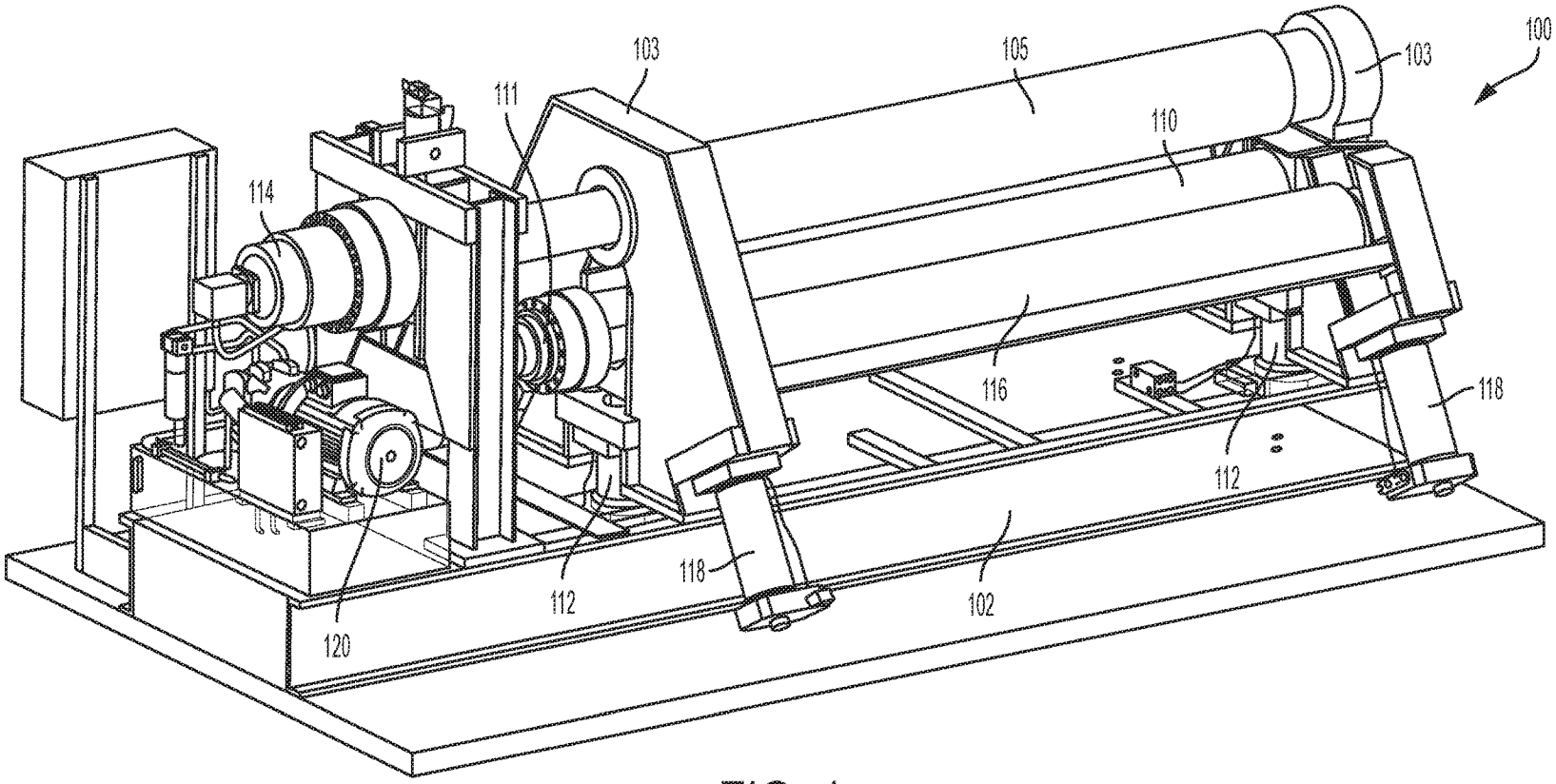
FIG. 1 is an overall view of a partially disassembled plate roll bending machine in accordance with the disclosure.

A partially disassembled view of a roll bending machine 100 in accordance with the disclosure is shown in FIG. 1. The machine 100 includes a frame 102 that rotatably supports a top roll 105 mounted in a fixed horizontal position and supported by bearings 103 allowing rotational motion. The machine 100 further includes an adjustably mounted bottom roll 110 positioned by a cooperating pair of hydraulic cylinders 112. The bottom roll 110 is powered by a hydraulic motor 111. Top roll 105 is mounted in a horizontal position and associated at one end or the drive end with a hydraulic motor 114. At an opposite end, the top roll is supported by a bearing housing that is arranged to swing between open and closed positions to allow the loading and unloading of plates or other work pieces into the machine 100, as appropriate.

The machine 100 further includes front and rear bending rolls 116 (only one is visible in FIG. 1 but is representative of the arrangement in the rear of the machine). Each bending roll 116 is supported on the frame 102 by a pair of cooperating cylinders 118, one disposed on each end, which can independently raise and lower the ends of the bending roll to produce cylindrical, conical, and other shapes in plates bent by the machine 100 during operation. The various cylinder actuators 112, 118 and others, may be fitted with pilot operated check valves to prevent lowering of the load should hydraulic pressure be unintentionally lost such as when a hydraulic hose breaks or there is an unexpected loss of hydraulic pressure in the system for another reason. In the illustrated embodiment, an electric motor 120 powers a hydraulic pump (not shown) that provides pressurized fluid to operate the cylinder actuators 112 and 118, the hydraulic motors 111 and 114, and other hydraulic actuation devices in the machine 100 during operation.

Figure 2:
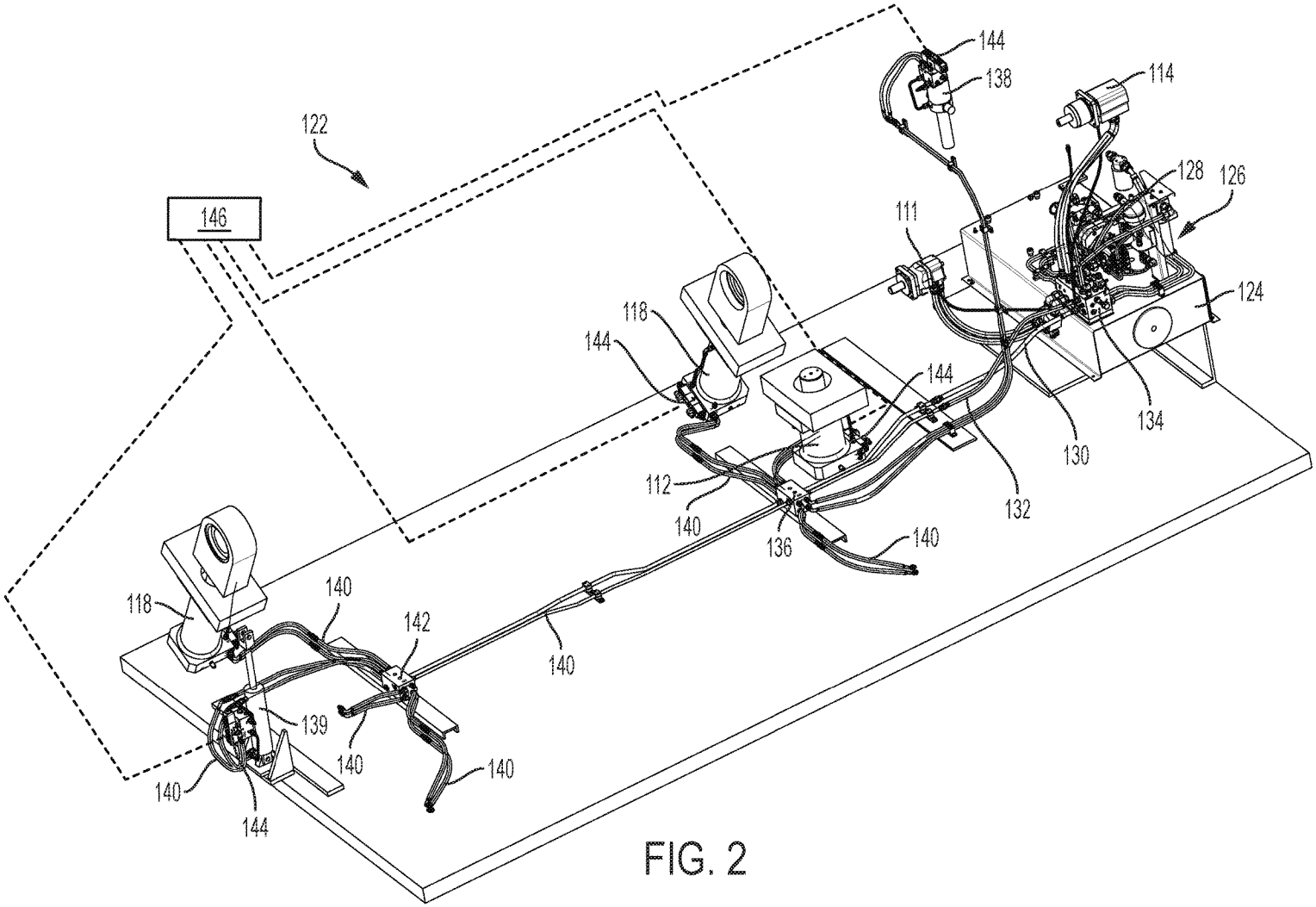
FIG. 2 is a partially disassembled view of the plate roll bending machine to illustrate a distributed hydraulic system in accordance with the disclosure.

A partially assembled view of the machine 100, to illustrate various components of a distributed hydraulic system (DHS) 122, is shown in FIG. 2. The DHS 122 includes various components and systems as shown, but it should be appreciated that different and/or additional components may be used to suit the type of machine used. Also, in the description that follows, structures and features that are the same or similar to corresponding structures and features that have been described are denoted and discussed using the same reference numerals previously used for simplicity.

As shown, the DHS 122 includes a fluid reservoir 124 that is part of a hydraulic power unit 126. The power unit 126 includes a pump 128 operated by the electric motor 120 (FIG. 1) to draw fluid from the reservoir 124 and to provide pressurized fluid into a network of conduits that includes a main feed 130 and a main return 132. During operation, pressurized fluid from the main feed 130 is made available for use at various actuators, which transform the fluid pressure into work, and return used fluid to the reservoir 124 via the main return conduit. A first manifold 134 fluidly connects the main feed and main return to lines providing fluid to operate the various cylinders on the machine. In the illustrated embodiment, the power unit 126 is shown physically placed on the machine 100, but it should be appreciated that the power unit 126 may be remotely placed or otherwise remotely associated with the machine 100, which is typical, especially for larger machines.

The DHS 122 further includes a distribution block 136. The distribution block 136 fluidly connects directly or indirectly the main feed and return to the two sets of bending roll lift cylinders 118 (only one set of cylinders is shown), and also supplies oil to the bottom roll positioning cylinders 112 (only one shown), a bearing housing swing cylinder 139, a top roll tilt cylinder 138 and others, via a network of conduits 140, which run in pairs and include a corresponding feed conduit, which is fluidly connected at all times to the main feed conduit 130 and carries fluid under pressure, and a corresponding return conduit, which is fluidly connected at all times to the main return conduit 132 and carries fluid that is returned to the reservoir 124 at a low pressure. A second distribution block 142 is disposed at another location of the machine to supply the surrounding actuators as shown. Additional distribution blocks similar to 136 and 142 may be installed in the DHS 122 to distribute pressurized fluid from the main feed 130 and main return 132 at other machine locations where actuators may be present.

During operation, fluid connections to the conduits 140 are accomplished at a valve block 144 that is installed at, or is integrated with, each of the cylinders 112, 139, 138 and 118. Each valve block 144 may include various components that control the flow of fluid to and from various portions of the respective cylinder, and can include proportional valves, counterbalance valves, solenoid valves, flow control valves, oil pressure sensors and the like, which are controlled by and/or are communicatively associated with a controller 146. The controller 146 may be physically located on or close to the machine, or may operate remotely. The fluid connections between the various valves and the cylinder are facilitated through a manifold that is connected to the particular cylinder. The manifold may be directly or indirectly connected to the cylinder, for example, on the cylinder housing, end cap, or a location on the frame of the machine that is adjacent to the cylinder. In this way, a decentralized hydraulic system can be established whereby a central manifold that includes all the valves in the machine, as was traditionally the case, is replaced by a number of different sub-manifolds that are located directly at each of the actuators that are being operated. In such decentralized arrangement, a supply of fluid from the pump is distributed at the various actuators, from where fluid to control each actuator is provided at a close proximity to the actuator itself, thus reducing or eliminating various elastic effects in the system.

Figure 3:
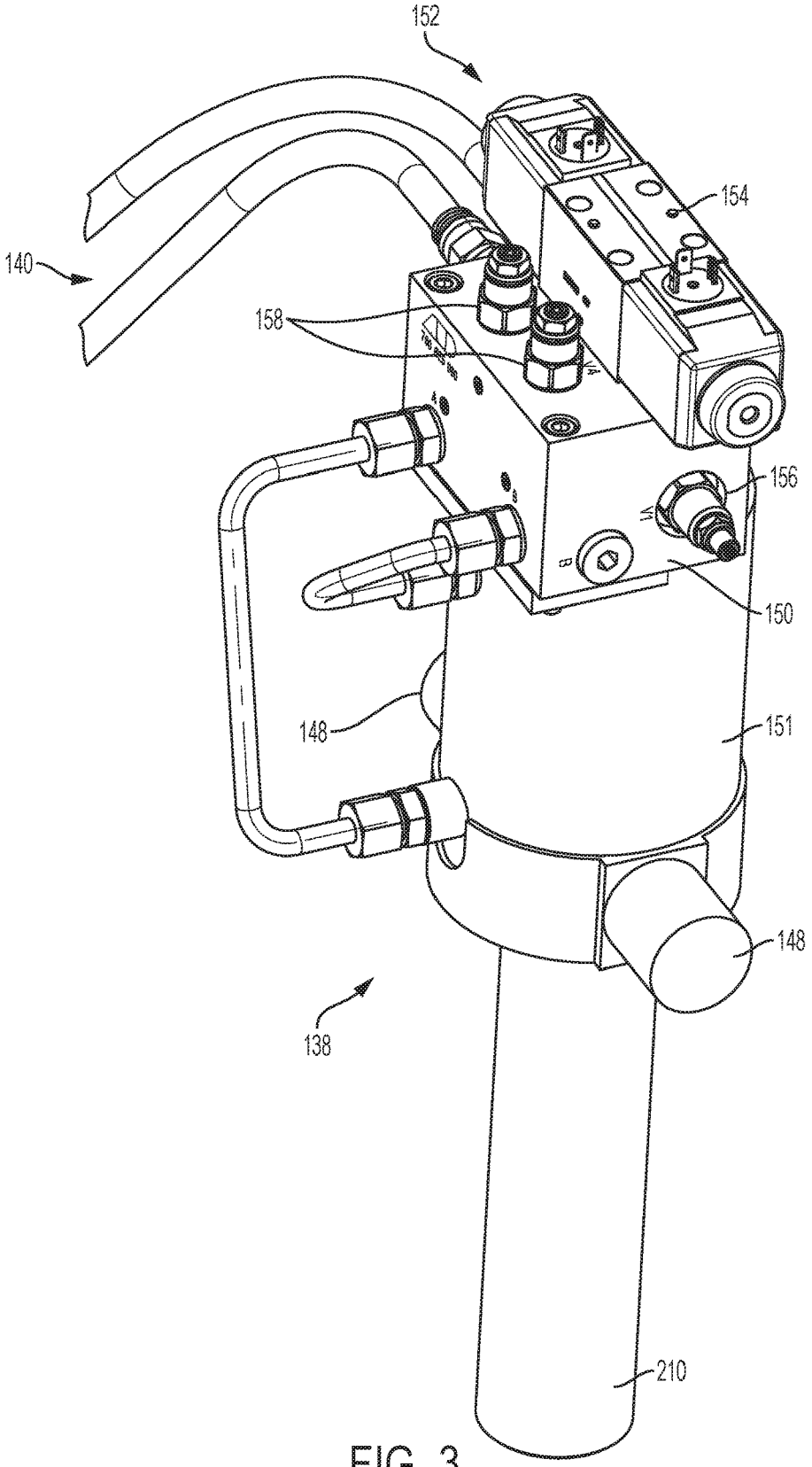
FIG. 3 is a hydraulic cylinder for a distributed hydraulic system in accordance with the disclosure.

An outline view of the top roll tilt cylinder 138 is shown in FIG. 3. The top roll tilt cylinder 138 is adapted to tilt top roll 105 when the hinged bearing housing 103 (FIG. 1) is in the open position to tilt the top roll 105 and raise the hinge end of the roll above a horizontal orientation for facilitating removal of a plate that has been rolled into a cone or cylinder. The top roll tilt cylinder 138 is configured for trunnion mounting onto the frame 102 with trunnions 148. A manifold 150, which represents the respective sub-manifold in the distributed hydraulic system arrangement of the machine 100, is mounted to the cylinder 138 and includes fluid connections that fluidly connect the cylinder 138 with the conduits 140 (FIG. 2). A valve system 152 includes a solenoid valve 154, a flow control valve 156 and two counterbalance valves 158. There are two flow control valves 156 mounted on manifold 150 but only one is visible.

By connecting the manifold 150 onto the cylinder 138, and incorporating the various valves onto the manifold 150, the total volume of oil that is provided to the cylinder by the various valves in the manifold is advantageously reduced to improve the response time of the cylinder and to also reduce elasticity in the hydraulic arrangement to improve accuracy and repeatability. In general, the velocity of actuation of the cylinder 138 depends on the rate at which oil is provided to the cylinder by flow control valves 156. The counterbalance valves 158 operate to hydraulically lock the cylinder at a desired position to prevent unwanted movement in the event hydraulic pressure is lost, for example, if a hose were to burst. Augmenting these advantages is also the configuration of hydraulic fluid passages within the cylinder, which fluidly connect the various operating chambers of the cylinder with appropriate ports in the manifold 150.

Figure 4:
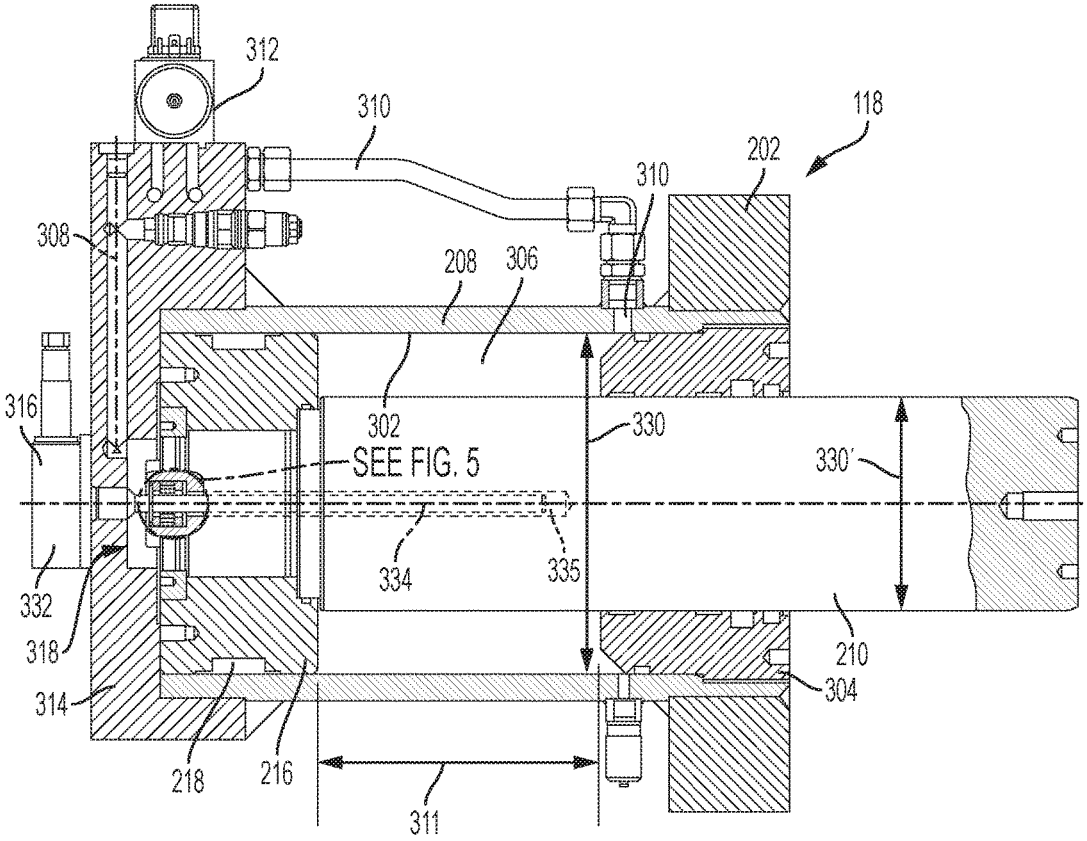
FIGS. 4 and 5 are cross section views of a hydraulic cylinder in accordance with the disclosure.
Figure 5:
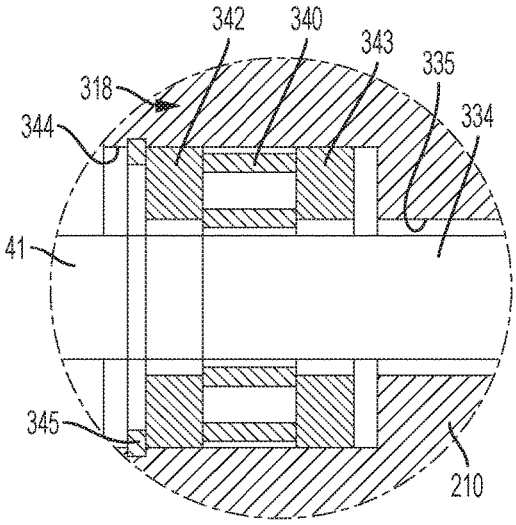

A sectioned view through hydraulic cylinder 112 (FIG. 1), which is similar in construction to cylinder 118 and is used in the present disclosure for illustration of the type of internal fluid connections and structures, is shown in FIGS. 4 and 5. In the illustrated embodiment, the cylinder 112 includes a plunger 216 that is slidably and sealably disposed within an internal bore 302 of the housing 208. As shown, the plunger 216 forms an external groove 218 that accommodates a seal (not shown) that sealably engages the inner surface of the bore 302 as the plunger 216 traverses its stroke 311. An outer end of the housing 208 is blocked by a header 304 having an annular shape that engages the inner surface of the bore 302 along an outer periphery and sealably and slidably accepts the post or rod 210 along an inner periphery.

As shown, the plunger 216 has an outer diameter 330 that is larger than a diameter 330' of a rod 210 such that hydraulic pressure present on either side of the plunger 216 within the internal chamber 306 of the housing 208 will cause the plunger 216 to move and push or pull the rod 210 relative to the housing 208. Hydraulic oil or fluid is provided on either side of the plunger 216 by hydraulic passages 308 and 310, which are controlled by a valve system 312. The valve 312, which is similar to the valve system 152 and manifold shown and described relative to FIG. 3, includes fluid connections to passages 308 and 310 that are associated with a leader block 314. The passage 308 is formed in solid metal material, which lessens the possibility of bursting and reduces elastic effects in the walls of the passages when the passage is full of pressurized oil. Similarly the passage 310 is formed at least partially by a steel tube, which provides similar advantages to the passage 308.

In the illustrated embodiment, the cylinder 112 fully encloses a position sensing and feedback arrangement, which is embodied as a non-contacting magnetic transducer. More specifically, the cylinder 112, and other cylinders in the system 122 that position the rolls, includes a magnetic, micro-pulse linear transducer 332 that is mounted on the cylinder cap or leader block 314. The transducer 332 includes a sensing rod 334 that is connected to a sensor housing 316 and extends into the bore 302 of the housing 208 concentrically relative to the rod 210. The rod 210 has a blind bore 335 extending therethrough in aligned relation to the sensing rod 334 and at a clearance therewith such that the rod 210 can move relative to the housing 208 as previously described without interfering with the sensing rod 334. Micropulse linear transducers are available in a number of resolutions from 0.002 to 0.1 mm. In the illustrated embodiment, a micropulse linear transducer having a 0.04 mm resolution is utilized, which during operation of the machine 100 provides a non-linearity specification of plus or minus 0.08 mm and a repeatability specification of plus or minus 0.08 mm.

Use of the micropulse linear transducer 332 provides a positioning accuracy potential that is at least six times better than can be expected with a string transducer. Micropulse linear transducers are also known as magneto-restrictive linear position sensors. The position data from such transducers represents the absolute distance between a magnet and the head end of the measuring rod 334. To achieve this arrangement, a magnet 340 is mounted in a bore 344 formed at the inner end 318 of the rod 210. The magnet 340 thus moves along with the rod 210 as the sensor rod 334 remains connected to the leader block 314. Magnet 340 is sandwiched between two non-magnetic spacers 342 and 343 and held in place in bore 344 by retaining ring 345. Other contactless linear measurement devices such as one based upon an inductive principal or one based on a Hall Effect principle could be used in place of the micropulse linear transducer 332.

During operation, as the position of the rod 210 changes with respect to the leader block 314, the magnetic field created by the magnet 340 as it traverses the sensing rod 334 will change as the distance of the magnet 340 changes with respect to a stem 41 of the sensing rod. This change in magnetic field will be sensed by the transducer 332, which will continuously provide a signal indicative of the absolute position or the change in position, as appropriate, to an electronic controller that controls operation of the valve 312. In such a control arrangement, a closed loop control scheme can be implemented to more accurately and quickly command the cylinder 118 to assume a desired extension or retraction in the position of the rod 210 relative to the housing 208 and, thus, the frame of the machine 100.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A hydraulic roll bending machine, comprising:

a frame;

a plate roller rotatably connected to the frame;

a hydraulic power unit;

a network of conduits fluidly connected to a main feed of hydraulic fluid and a main return of hydraulic fluid of the hydraulic power unit, the network of conduits including a distribution block;

at least one hydraulic actuator having a housing, the at least one hydraulic actuator being associated with the plate roller, the housing forming one or more fluid passages therein that are fluidly connected with activation chambers of the at least one hydraulic actuator;

a valve system connected onto the housing in selective fluid communication with the one or more fluid passages, the valve system including a manifold that is fluidly connected with the distribution block, the valve system being in fluid communication with the network of conduits and arranged to selectively fluidly interconnect the one or more fluid passages with the network of conduits to operate the at least one hydraulic actuator;

at least one additional hydraulic actuator having a housing, the at least one additional hydraulic actuator being associated with the plate roller, the housing forming one or more fluid passages therein that are fluidly connected with activation chambers of the at least one additional hydraulic actuator;

an additional valve system connected onto the housing in selective fluid communication with the one or more fluid passages, the valve system including an additional manifold that is fluidly connected with the distribution block, the additional valve system being in fluid communication with the network of conduits and arranged to selectively fluidly interconnect the one or more fluid passages with the network of conduits to coordinate operation of the at least one additional hydraulic actuator with operation of the at least one hydraulic actuator.

2. The hydraulic roll bending machine of claim 1, wherein the plate roller is an upper gripping roller, and wherein the hydraulic roll bending machine further includes:

a lower gripping roller arranged parallel to the upper gripping roller;

a drive motor operating to drive at least one of the upper gripping roller and the lower gripping roller;

wherein the at least one hydraulic actuator is a hydraulic cylinder interconnected between the frame and at least one of the upper gripping roller and the lower gripping roller, the hydraulic cylinder imparting a force when extended to push the upper and lower gripping rollers together for gripping a plate workpiece disposed between the upper and lower gripping rollers during operation; and wherein the at least one additional hydraulic actuator is interconnected between the frame and the at least one of the upper and lower gripping rollers.

3. The hydraulic roll bending machine of claim 2, further comprising a third roller that is adjustably mounted onto the frame by at least a third hydraulic cylinder, the third roller being displaceable for bending the plate workpiece under force provided by the third hydraulic cylinder.

4. The hydraulic roll bending machine of claim 3, wherein the third hydraulic cylinder includes a third valve system in fluid communication with the network of conduits via a third manifold that is connected to the distribution block and arranged to operate the third hydraulic cylinder.

5. The hydraulic roll bending machine of claim 4, further comprising a fourth roller that is adjustably mounted onto the frame by at least a fourth hydraulic cylinder, the fourth roller being disposed opposite the third roller relative to the frame, the fourth roller being adjustably mounted onto the frame by the fourth hydraulic cylinder and being displaceable for bending a second side of the plate workpiece.

6. The hydraulic roll bending machine of claim 1, therein the valve system includes a fluid manifold connected directly onto the housing and in selective fluid communication with a fluid passage that is formed into a structure of the housing.

7. The hydraulic roll bending machine of claim 6, wherein the valve system includes at least one of a solenoid valve, a flow control valve and a counterbalance valve.

8. The hydraulic roll bending machine of claim 1, further comprising a position feedback sensor integrated into the at least one hydraulic actuator.

9. A hydraulic roll bending machine, comprising:

a frame;

a plate roller rotatably connected to the frame;

a hydraulic power unit;

a network of conduits fluidly connected to a main feed of hydraulic fluid and a main return of hydraulic fluid of the hydraulic power unit, the network of conduits including a distribution block;

at least one hydraulic actuator having a housing, the at least one hydraulic actuator being associated with the plate roller, the housing forming one or more fluid passages therein that are fluidly connected with activation chambers of the at least one hydraulic actuator;

a valve system connected onto the housing in selective fluid communication with the one or more fluid passages, the valve system including a manifold that is fluidly connected with the distribution block, the valve system being in fluid communication with the network of conduits and arranged to selectively fluidly interconnect the one or more fluid passages with the network of conduits to operate the at least one hydraulic actuator; and a position feedback sensor integrated into the at least one hydraulic actuator.

10. The hydraulic roll bending machine of claim 9, wherein the position feedback sensor is a micropulse transducer.

11. The hydraulic roll bending machine of claim 9, wherein the position feedback sensor has a measuring resolution less than 0.5 mm.

12. The hydraulic roll bending machine of claim 9, wherein the position feedback sensor operates based on an inductive principal.

13. The hydraulic roll bending machine of claim 9, wherein the position feedback sensor operates based on a Hall Effect principal.

14. The hydraulic roll bending machine of claim 9, wherein the one or more fluid passages are integrated with the housing and have rigid walls.

15. The hydraulic roll bending machine of claim 9, wherein the hydraulic power unit includes a motor, a hydraulic pump having an outlet, the hydraulic pump being operated by the motor, and a fluid reservoir, and wherein the network of conduits includes a pair of sets of conduits, one set of conduits being fluidly connected to the outlet of the hydraulic pump and the other set of conduits being fluidly connected to the fluid reservoir.

16. The hydraulic roll bending machine of claim 15, wherein the network of conduits further includes at least one additional distribution block that distributes oil from the hydraulic pump to a plurality of hydraulic actuators on the hydraulic roll bending machine.

17. The hydraulic roll bending machine of claim 9, further comprising a controller operably associated with and configured to control an operation of the hydraulic power unit and the valve system.

18. The hydraulic roll bending machine of claim 17, wherein the at least one hydraulic actuator is a hydraulic piston having a plunger that is moveable relative to the housing and connected to a rod, wherein the housing is connected to the frame and the rod is connected to one end of the plate roller.

19. The hydraulic bending machine of claim 18, further comprising a sensor integrated with the hydraulic cylinder, the sensor being integrated within a bore of the housing and disposed to sense a distance of the plunger relative to one end of the housing and to provide a signal indicative of the distance to the controller.

20. The hydraulic bending machine of claim 19, further comprising a magnet associated with the sensor and arranged to provide a non-contacting magnetic signal to the sensor, wherein the signal is indicative of the distance and is based on the non-contacting magnetic signal.

* * * * *